United States Patent [19]

Hradisky

[11] Patent Number: 5,071,008

[45] Date of Patent: Dec. 10, 1991

[54] NESTABLE AND STACKABLE CONTAINERS

[75] Inventor: John L. Hradisky, Medina, Ohio

[73] Assignee: Rubbermaid Incorporated, Wooster, Ohio

[21] Appl. No.: 622,946

[22] Filed: Dec. 6, 1990

[51] Int. Cl.[5] ..... B65D 21/04

[52] U.S. Cl. ..... 206/507; 206/519

[58] Field of Search ..... 206/503, 505, 507, 515, 206/518, 519

[56] References Cited

U.S. PATENT DOCUMENTS

| | | | |
|---|---|---|---|
| 3,270,913 | 9/1966 | Bridenstine et al. | 206/507 |
| 3,326,410 | 6/1967 | Asenbauer | 206/507 X |
| 3,404,804 | 10/1968 | Frater et al. | 206/505 |
| 3,434,625 | 3/1969 | Embry, Jr. | 206/519 X |
| 3,534,866 | 10/1970 | Asenbauer | 206/507 X |
| 4,664,347 | 5/1987 | Brown et al. | 206/519 X |

*Primary Examiner*—Steven M. Pollard

*Attorney, Agent, or Firm*—Renner, Kenner, Greive, Bobak, Taylor & Weber

[57] ABSTRACT

A container (10) is capable of being stacked on or nested within a like container (10A). The container includes a bottom (14), with a front wall (11), a rear wall (12) and two side walls (13) extending upwardly from the bottom (14) to an upper rim (15) thereby forming the container (10) with an open top. The side walls (13) taper away from each other as they extend upwardly from the bottom (14) to the rim (15) and are each provided with outer depressions (20, 21) forming inner projections (22, 23). The top of each of the inner projections (22, 23) is formed as a ledge (32) which includes an upper step (33) and a lower step (34). A rib (35) extends upwardly from each lower step (34). Sockets (36) are formed in the bottom (14) and the socket (36A) of the like container (10A) is alignable with and receives the ribs (35) of the container (10) so that the containers (10, 10A) may be stacked. The outer depressions (20, 21) are spaced from each other to form inner depressions (24, 25) and outer projections (26, 27) in each side wall (13). The rim (15) has a first sloping surface (19) extending from the front wall (11) along each side wall (13) and a second sloping surface (18) extending from the rear wall (12) to the first sloping surface (19). The container (10) may then be nested within the like container (10A) by positioning the container (10) on bottom (14) or the like container (10A) on sloping surface (19A) and sliding the outer projections (26A, 27A) of the like container (10A) into the inner depression (24, 25) of the container (10) while at the same time sliding outer depressions (20A, 21A) of the like container (10A) over the inner projections (22, 23) of the container (10).

23 Claims, 4 Drawing Sheets

NESTABLE AND STACKABLE CONTAINERS

TECHNICAL FIELD

This invention relates to containers of the type which can either be stacked one on another or nested within each other. More particularly, this invention relates to such containers which, when stacked, provide a convenient way of segregating items to be stored therein and which, when nested, take up a minimal amount of space.

BACKGROUND ART

When a plurality of containers are used to hold items to be segregated by size, type, color, weight or the like, such as laundry, trash or the like, it is often a convenient savings of floor space if such containers can be stacked on each other. However, for storage, shipment, marketing/display and like purposes, it is desirable that these same containers have the ability to nest within each other in a space conservation effort.

Many varieties of such nestable, yet stackable, containers are known in the art. Most, however, suffer from one or more deficiencies. For example, in many such containers, the stable stacking thereof is not a simple process with the user having to exercise a high degree of care in tending to the proper stacking placement of the containers. In addition, when stacked, most prior art arrangements do not provide a conveniently sufficient access opening, and in some instances, the containers actually must be at least partially unstacked in order to gain access to the contents. Moreover, these same containers, when nested, because of their configuration, do not nest in a vertical fashion thereby rendering it inconvenient, if not impossible, to nest many such containers and ship them packaged from the factory to their destination.

DISCLOSURE OF THE INVENTION

It is thus a primary object cf the present invention to provide a container which can be conveniently, selectively, stacked upon or nested with a like container or containers.

It is another object of the present invention to provide a container, as above, which is configured so that when stacked upon a like container or containers, access to each container in the stack is readily available.

It is a further object of the present invention to provide a container, as above, which can be easily and positively positioned on a like container for stacking purposes.

It is an additional object of the present invention to provide a container, as above, which can be nested with a like container or containers either in an upright or inverted position thereby providing two nested configurations, at least one of which is suitable for packaging a plurality of nested containers.

These and other objects of the present invention, as well as the advantages thereof over existing prior art forms, which will become apparent from the description to follow, are accomplished by the means hereinafter described and claimed.

In general, a container capable of being stacked on a like container includes a bottom surface and a front, a rear and two side walls extending upwardly from the bottom surface to an upper rim defining an open top. At least one ledge is formed in each of the side walls and includes an upper step and a lower step. A rib extends upwardly from each lower step. Sockets formed in the bottom surface are alignable with the ribs of the like container so that the sockets may engage the ribs of the like container for stacking.

The container is also capable of being nested within the like container. To that end, the side walls taper away from each other as they extend upwardly from the bottom surface to the upper rim and are provided with outer depressions forming inner projections on the inside thereof. The top of each inner projection carries the ledge which carries the rib. The outer depressions in the side walls are spaced from each other to form inner depressions and outer projections in each side wall. The upper rim has a first slope extending from the front wall along the side walls and a second slope extending from the rear wall to the first slope. The container is thereby nestable within the like container in one of two manners. The container may either be positioned on the bottom surface or on the first slope of the rim and then the outer projections in each side wall of the like container are received in the inner depressions of the container while at the same time the outer depressions of each side wall of the like container receive the inner projections in each side wail of the container.

A preferred exemplary container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
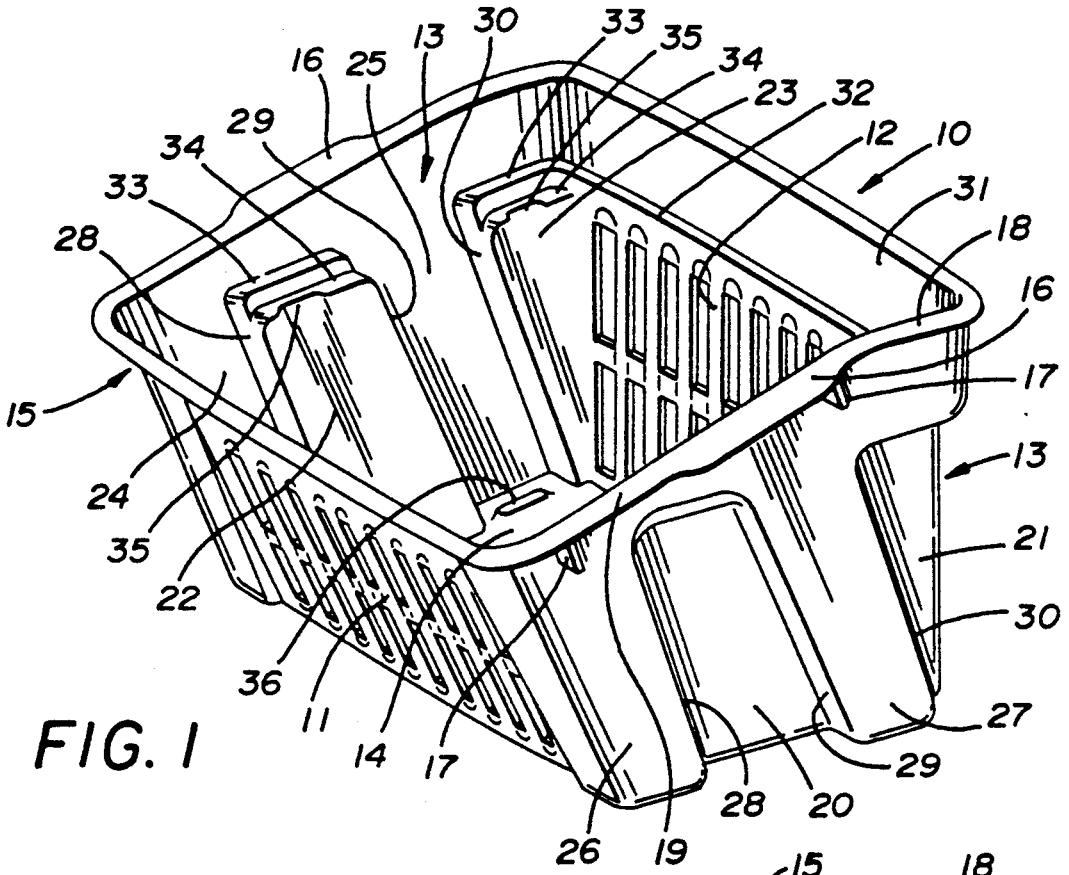
FIG. 1 is a perspective view cf a container made in accordance with the concepts of the present invention.

A container which includes the concepts of the present invention is indicated generally by the numeral 10 in the drawings and is shown in the form of a laundry basket having the material-saving and decorative apertured front and rear walls generally indicated by the numerals 11 and 12, respectively, found in many laundry baskets. However, the present invention has applicability to any type of container wherein it may be desirable to stack like containers during use, and in particular where it is desirable to segregate items, such as laundry, in separate containers. Other typical usages would relate to the segregation of small parts or the segregation of refuse, trash, or the like for recycle purposes. In these instances, front wall 11 and rear wall 12 may well be provided in a solid, as opposed to apertured, form not only for strength purposes which might be required to hold the heavier refuse, but also for confinement purposes which may be necessary considering the nature of refuse or the small parts and other miscellaneous items.

Container 10 also includes two specially configured and basically identical side walls indicated generally by the numeral 13. Front wall 11, rear wall 12 and side walls 13 and all components carried thereby extend upwardly from a generally planar bottom 14 and end as a continuous, outturned, top rim generally indicated by the numeral 15. Front wall 11, rear wall 12 and side walls 13 thereby create an open top, material-receiving container with the opening being defined by rim 15.

For nesting purposes, as will hereinafter become evident, it is important that walls 13 taper outwardly from bottom 14 to rim 15, with a taper of approximately three to four degrees being preferred. The outturned rim 15 can be optionally provided with outwardly extending handles 16 to facilitate the transportation of container 10. In addition, two nesting ribs 17 extend downwardly from outturned rim 15 along the top of each side wall 13, the purpose of which will be hereinafter described.

Figure 2:
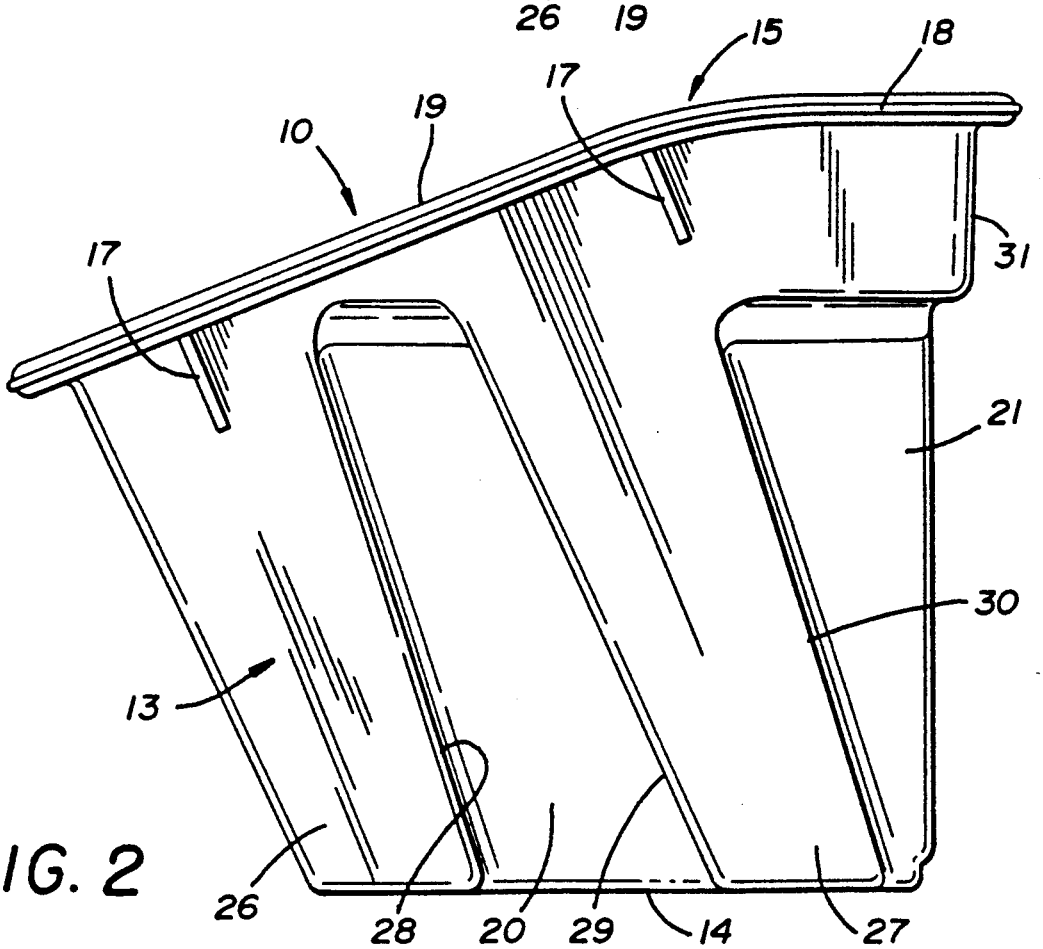
FIG. 2 is a side elevational view of the container of FIG. 1.
Figure 3:
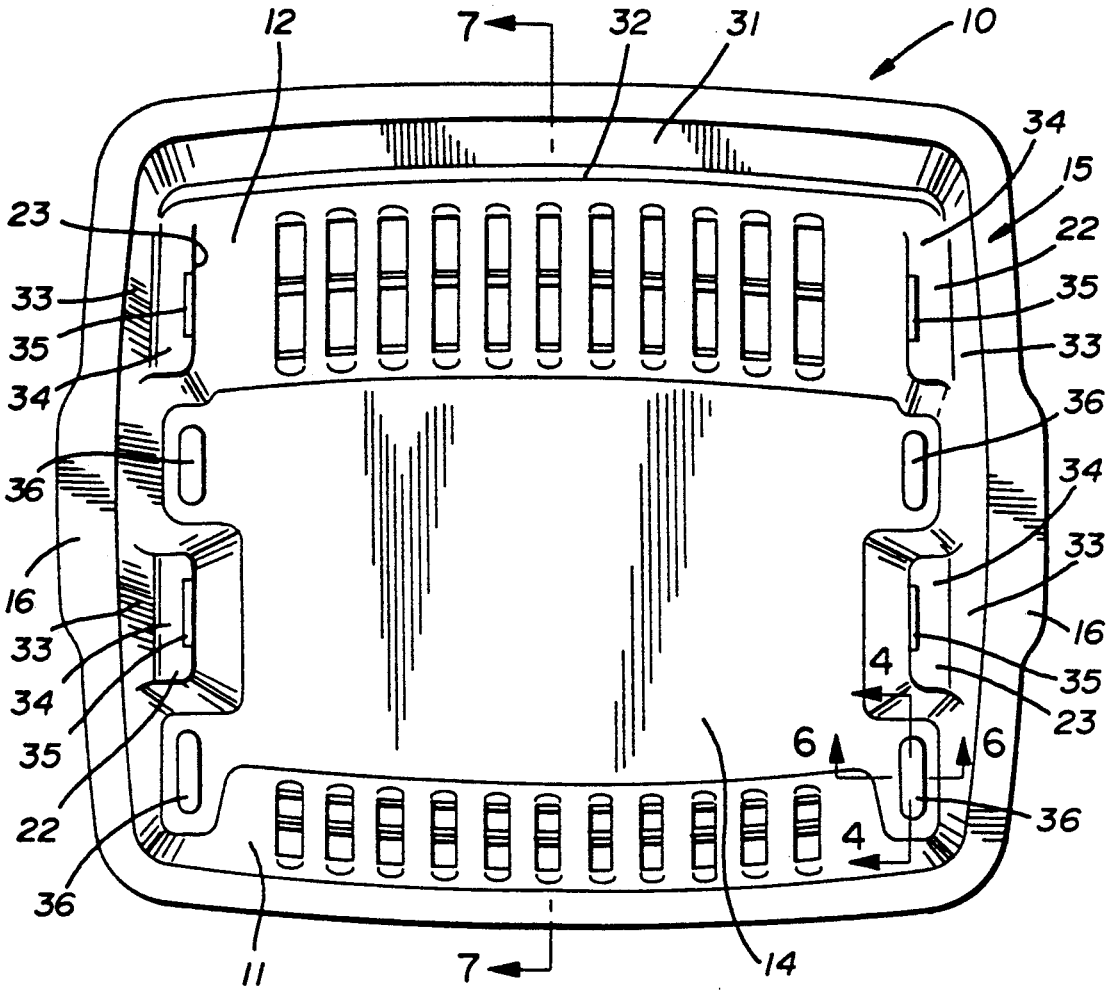
FIG. 3 is a top plan view of the container of FIG. 1.

As shown, for example, in FIG. 2, continuous top rim 15 is not parallel to bottom 14. Rather, rim 15 includes a rear, generally horizontal, portion 18 which terminates inwardly as a downwardly inclined portion 19 which extends from portion 18 down to front wall 11. Thus, it is evident that rear wall 12 is higher than front wall 11 which not only provides access to the containers when stacked, as will hereinafter be described, but also increases the volume of container 10. Moreover, as will hereinafter be described in more detail, inclined portion 19 provides a surface upon which containers may be invertedly stacked for shipment in cartons.

Each side wall 13 of container 1 is formed with a front depression 20 and a rear depression 21 in the outer walls thereof which form complementary inner projections 22 and 23, respectively, extending inwardly into container 10. The recess or depression 24 formed on the inside of each wall 13 between front wall 11 and projection 22 and the recess or depression 25 formed on the inside of each wall 13 between projection 22 and projection 23 form complementary outer projections 26 and 27, respectively, on the outside of walls 13. Thus, outer projection 26 is between front wall 11 and front depression 20 and outer projection 27 is between front and rear depressions 20 and 21.

As shown, the side walls or edges 28 and 29 which form front depression 20 and complementary projection 22 are preferably tapered inwardly from bottom to top resulting in a depression 20 and projection 22 which is smaller at the top than at the bottom. Similarly, side wall or edge 30 of rear depression 21 tapers outwardly, from bottom to top, with respect to side wall 29 of depression 20, thereby forming the tapered recess 25 and outer projection 27, with the top of recess 25 and outer projection 27 thereby being wider than the bottom thereof. Front wall 11 likewise tapers outwardly, from bottom to top with respect to side wall 28 of depression 20 and projection 22, such that the top of recess 24 and projection 26 is wider than the bottom thereof. The taper of walls 28 and 29 relative to each other, the taper of walls 29 and 30 relative to each other, and the taper of walls 11 and 28 relative to each other can be on the order of three degrees. As will hereinafter become evident, for nesting purposes rear wall 12 can be oriented generally vertically or perpendicular to bottom 14. Above the slotted decorative portion of rear wall 12, however, is a solid portion 31 which is positioned somewhat rearwardly outward from the slotted decorative portion forming a ledge 32 at the junction thereof. Solid portion 31, while too being generally vertical to horizontal, is preferably drafted at a slight angle, approximately three degrees from vertical, thereby being at an angle less than ninety degrees to portion 18 of top rim 15.

Figure 5:
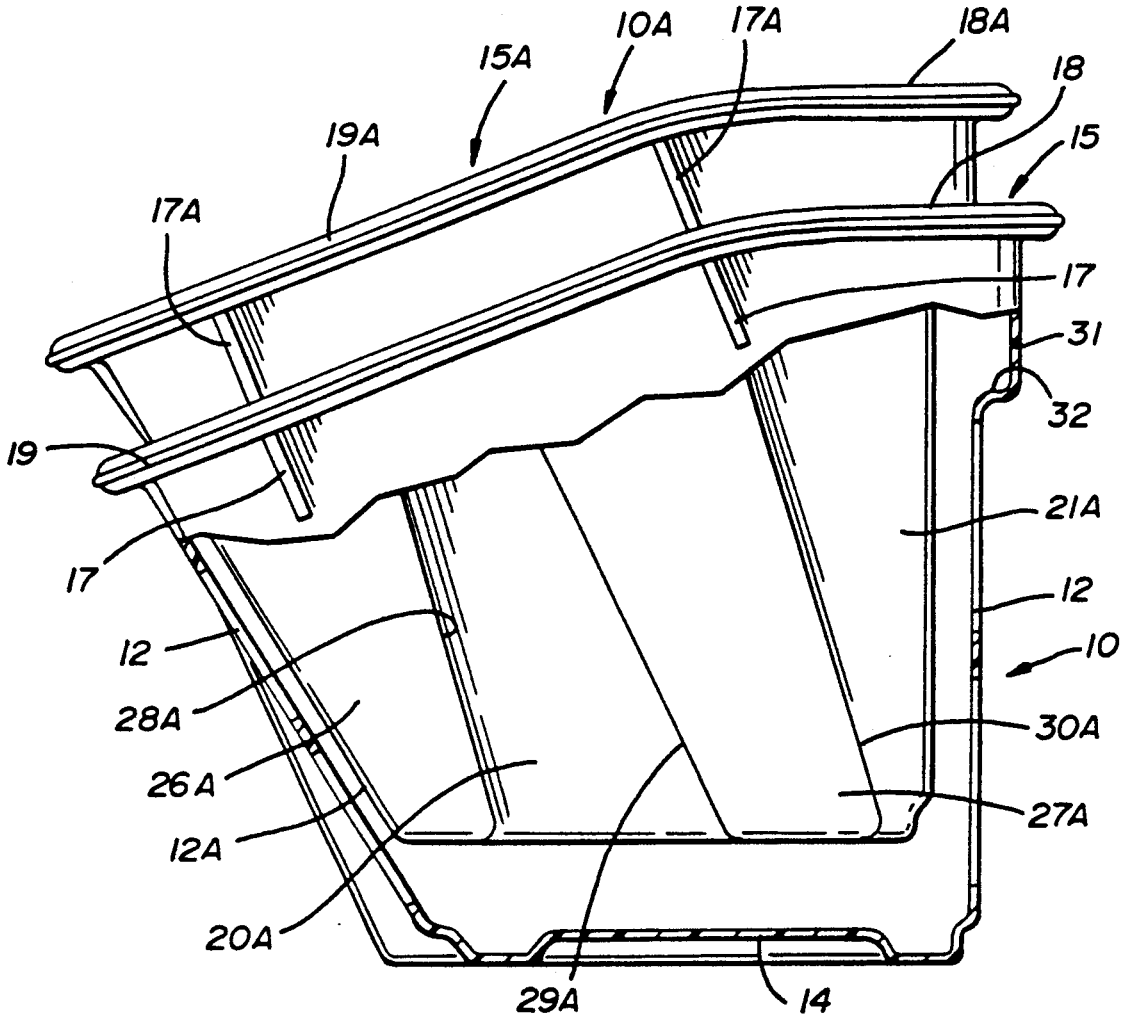
FIG. 5 is a somewhat schematic side elevational view showing a second like container nested within the container, the container being broken away.

With the side walls 13 being so configured, container 10 can be nested with a like container, designated 10A, as shown in FIG. 5. It should be noted that all the elements of like container 10A shown are numbered with the same numbers as container 10 followed by the suffix A. By inserting container 10A into container 10 from the front at an angle, tapered outer projection 26A of each wall 13A can slide within tapered recess or depression 24 of each wall 13 and likewise tapered outer projection 27A of each wall 13A can slide within tapered recess or depression 25 of each wall 13. Of course, at this same time tapered depression 20A in each wall 13A is sliding over tapered inner projection 22 in each wall 13 and tapered depression 21A in each wall 13A is sliding over tapered inner projection 23 in each wall 13. Such nesting, as shown in FIG. 5, can readily be accomplished because of all of the tapers in walls 13 and 13A, previously described, as well as the complementary nature of the configuration of walls 13 and 13A. In order to prevent an undesirable wedging of container 10A within container 10, nesting ribs 17A will engage top rim 15, as shown in FIG. 5, which serves to thereby define a stop point for the downward movement of container 10A within container 10.

It should thus be evident that any number of containers may be nested, as may be desired by the user in the home or the retailer for display purposes, without taking up unnecessary floor space. However, if several containers were to be nested as shown in FIG. 5, it would be evident that the front-to-back (left to right in FIG. 5) dimension of the nested containers would increase because of the cascading nature of the nested containers. As such, not only could such become unstable resulting in the possible tipping of the stack, but also for shipping purposes, for example, an extraordinarily large box or carton would be required. However, if the nested containers are inverted with the top container, for example, inclined portion 19A of rim 15A of container 10A, being positioned on the floor, the plurality of nested containers becomes vertical, that is, of a constant lateral dimension. As such, when a large plurality of containers are nested, they may be inverted and take up even less floor space, or as indicated above, be placed in a smaller shipping carton.

Figure 4:
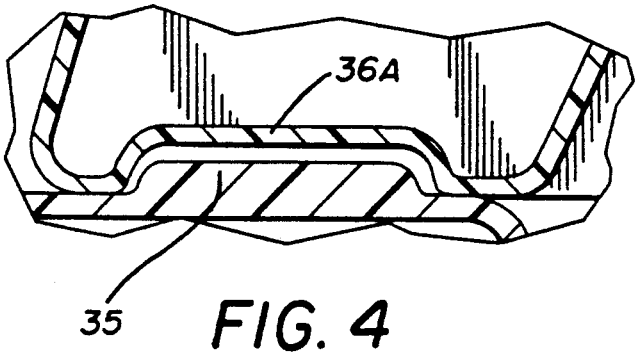
FIG. 4 is a fragmented sectional view taken substantially along line 4—4 of FIG. 3 but showing the container in a stacked position with a like container.
Figure 6:
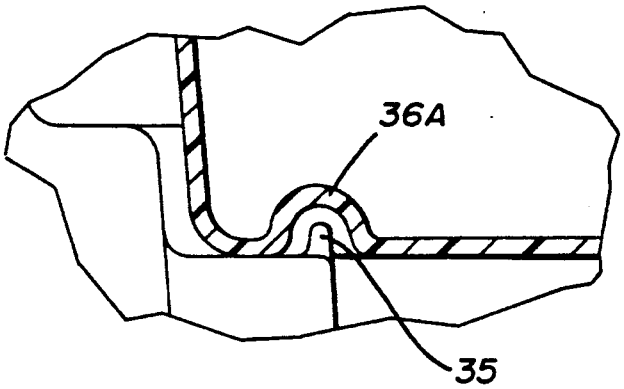
FIG. 6 is a fragmented sectional view taken substantially along line 6—6 of FIG. 3 but showing the container in a stacked position with a like container as in FIG. 4.

Container 10, in addition to being nestable with a like container, such as container 10A, is also configured so as to be stacked with like containers. To this end the top of inner projections 22 and 23 of side walls 13 are each provided with an upper step 33 and a lower step 34, with the upper step 33 of projection 23 being contiguous with ledge 32 of rear wall 12. Each lower step 34 is provided with an upwardly extending rib 35, while the bottom 14 of container 10 includes four cup-like sockets 36. Sockets 36 extend upwardly within container 10 and are alignable with ribs 35. As such, as best shown in FIGS. 4 and 6, ribs 35 of container 10 can receive sockets 36A of a like container 10A to stack a plurality of containers as shown in FIG. 7.

The positioning of ribs 35 on lower steps 34 adjacent to upper steps 33 assists in the positive and facile stacking of two like containers. Thus, to stack a container 10A onto a container 10, for example from the nested position of FIG. 5, container 10A is merely lifted and moved rearwardly so that sockets 36A are generally over the top of steps 33 and 34 of inner projections 22 and 23. However, sockets 36A need not be precisely aligned with ribs 35 at this point in time because as container 10A is lowered, steps 33 will engage the outside of the lower portions of projections 26A and 27A of side wall 13A and guide sockets 36A onto ribs 35. Such assures a positive stacking, without undue care, of container 10A on container 10 as shown in FIG. 7.

Figure 7:
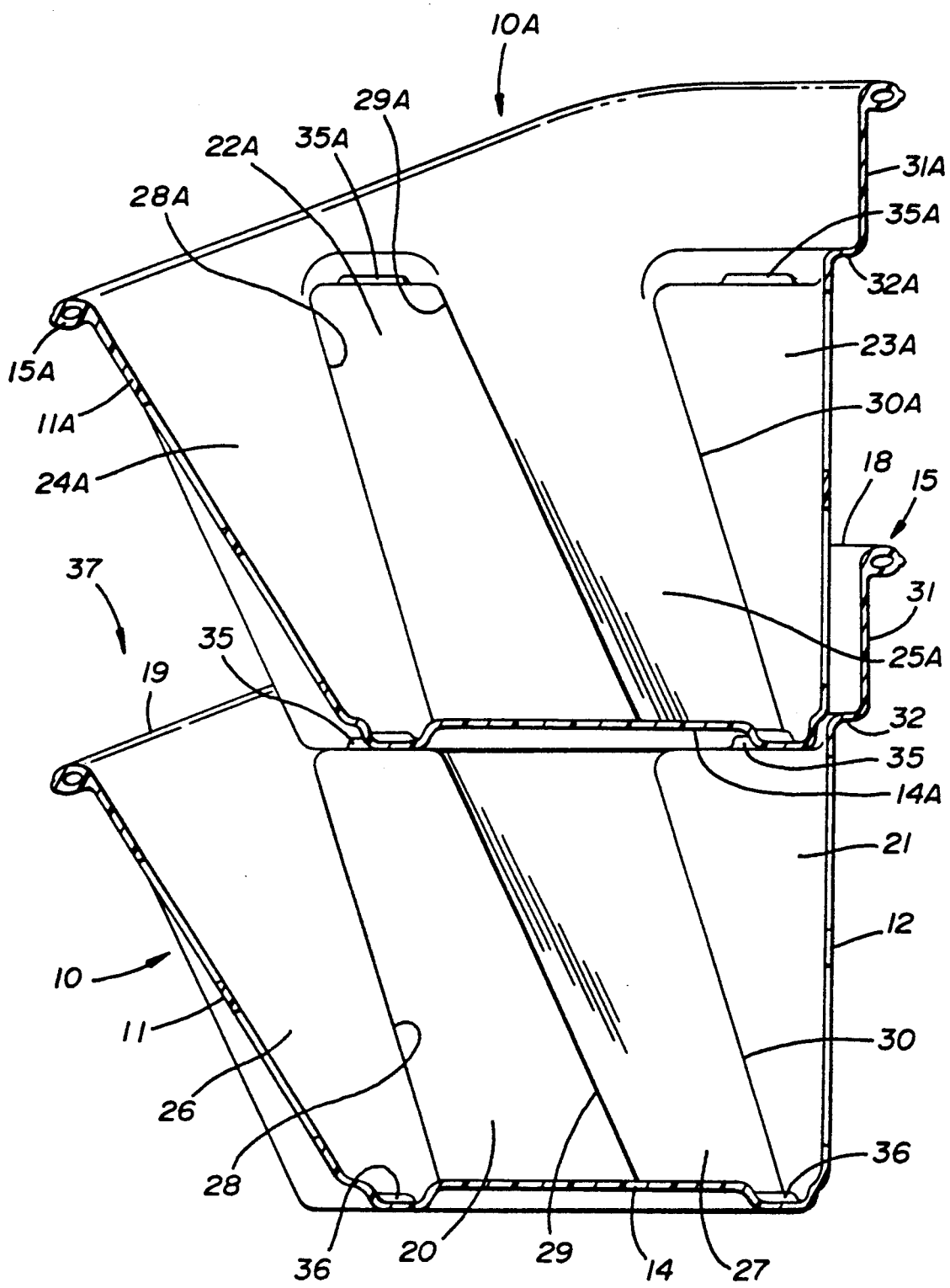
FIG. 7 is a somewhat schematic sectional view taken substantially along line 7—7 of FIG. 3 but showing a like container stacked onto the container as in FIGS. 4 and 6.

When stacked, as shown in FIG. 7, because front wall 11 preferably extends outwardly at an angle of approximately forty-five degrees from vertical, an opening designated by the numeral 37 is provided for access to container 10 between front wall 11A of container 10A and rim portion 19 of container 10. The size of opening 37 can be varied, for example, by altering the angle of front wall 11. Thus, in the case of a laundry container 10, opening 37 should be of a size to permit the convenient placement of laundry into container 10 to be sorted, for example by color, from laundry placed in container 10A. In other applications, such as the separation of refuse by types, opening 37 can be sized to permit the entrance of the largest typical refuse items, for example, a two liter bottle.

It should thus be evident that a container constructed according to the concepts of the present invention is of a configuration which can be conveniently nested and/or stacked with a like container and thus accomplishes the objects of the present invention and substantially improves the art.

I claim:

1. A container, selectively capable of being stacked on or nested within a like container, comprising a bottom surface; a front wall, rear wall, and two side walls extending upwardly from said bottom surface to an upper rim which defines an open top, material receiving portion, of the container; said upper rim having two slopes, a first slope extending from said front wall and along said side walls and a second slope extending from said rear wall along said side walls to said first slope; said second slope being generally horizontal and said first slope being at an angle to horizontal, said upper rim of said first slope being substantially longer than said upper rim of said second slope; said front wall tapering outwardly away from said rear wall so that when the like container is stacked on the container an access opening to the open top of each container is formed at the front thereof; said side walls tapering away from each other as they extend upwardly from said bottom surface to said open top; an outer depression in each said side wall forming an inner projection in each said side wall; a ledge formed near the top of each said inner projection, each of said ledges having an upper step and a lower step; a rib extending upwardly from each said lower step; and a socket formed in said bottom surface for each rib; said sockets being alignable with the ribs of the like container so that each said socket can engage each rib of the like container for stacking the like container on the container; the relative position of said sockets and said ribs being such that when the like container is stacked on the container the front wall of the like container is above and adjacent to said front wall of the container and the rear wall of the like container is above and adjacent to said rear wall of the container thereby aligning the access opening of the like container with said access opening of the container; the container being nestable within the like container by positioning the like container so that its outer depressions in each side wall are received around said inner projections of the container.

2. A container according to claim 1 wherein said rear wall is higher than said front wall.

3. A container according to claim 1 further comprising rib means extending from said open top downwardly along each said side wall, said rib means being adapted to engage the open top of the like container when the container is nested within the like container.

4. A container according to claim 1 wherein there are a plurality of outer depressions in each said side wall, said outer depressions being spaced from each other to form spaced inner depressions and spaced outer projections in each said side wall, said outer projections being received in the inner depressions of the like container when the container is nested with the like container.

5. A container according to claim 4 wherein said outer depressions and said inner projections in each said side wall are tapered having side edges which converge toward each other as said outer depressions and said inner projections extend upwardly in each said side wall from said bottom surface toward said open top.

6. A container according to claim 5 wherein said inner depressions and said outer projections in each said side wall are tapered having side edges which diverge from each other as said inner depressions and said outer projections extend upwardly in each said side wall from said bottom surface toward said open top.

7. A container according to claim 1 further comprising an upper rim along said open top; said upper rim having two slopes, a first slope extending from said front wall and along said side walls and a second slope extending from said rear wall along said side walls to said first slope; the container being nestable with the like container by placing the container selectively on said bottom surface or on said first slope of said upper rim.

8. A container according to claim 7 wherein said rear wall is generally perpendicular to said bottom surface but at an angle less than ninety degrees to said second slope of said upper rim.

9. A container, selectively capable of being stacked on or nested within a like container, comprising a bottom surface, a front wall, a rear wall, and two side walls extending upwardly from said bottom surface to an upper rim which defines an open top, material receiving portion, of the container; said rear wall being higher than said front wall with said front wall tapering outwardly away from said rear wall so that when the like container is stacked on the container an access opening to the open top of each container is formed at the front thereof; said side walls tapering away from each other as they extend upwardly from said bottom surface to said upper rim; outer depressions in each said side wall forming inner projections in each said side wall; said outer depressions in each said side wall being spaced from each other to form inner depressions and outer projections in each said side wall; a ledge formed near the top of each said inner projection; a rib extending upwardly from each said ledge; and a socket formed in said bottom surface for each said rib; said sockets being alignable with the ribs of the like container so that each said socket can engage each rib of the like container for stacking the container on the like container; the relative position of said sockets and said ribs being such that when the like container is stacked on the container the front wall of the like container is above and adjacent to said front wall of the container and the rear wall of the like container is above and adjacent to said rear wall of the container thereby aligning the access opening of the like container with said access opening of the container; said upper rim having two slopes, a first slope extending from said front wall and along said side walls and a second slope expending from said rear wall along said side walls to said first slope; said second slope being generally horizontal and said first slope being at an angle to horizontal, said upper rim of said first slope being substantially longer than said upper rim of said second slope; the container being nestable within the like container by selectively positioning the container on said bottom surface or on said first slope of said upper rim and positioning the like container so that its outer projections in each side wall are received in said inner depressions of the container and so that the outer depressions in each side wall of the like container receive said inner projections in each said side wall; said container and the like container when nested and when positioned on said first slope having a constant outer lateral dimension.

10. A container according to claim 9 wherein said rear wall is generally perpendicular to said bottom surface but at an angle less than ninety degrees to said second slope of said upper rim.

11. A container according to claim 9 further comprising rib means extending from said upper rim downwardly a preselected distance along each said side wall, said rib means being adapted to engage the upper rim of the like container when the container is nested within the like container.

12. A container according to claim 9 wherein said outer depressions and said inner projections in each said side wall are tapered having side edges which converge toward each other as said outer depressions and said inner projections extend upwardly in each said side wall from said bottom surface toward said upper rim.

13. A container according to claim 12 wherein said inner depressions and said outer projections in each said side wall are tapered having side edges which diverge from each other as said inner depressions and said outer projections extend upwardly in each said side wall from said bottom surface toward said upper rim.

14. A container, capable of being stacked on a like container, comprising a bottom surface; a front wall, rear wall and two side walls extending upwardly from said bottom surface to an upper rim which defines an open top, material receiving portion, of the container said upper rim having two slopes, a first slope extending from said front wall and along said side walls and a second slope extending from said rear wall along said side walls to said first slope; said second slope being generally horizontal and said first slope being at an angle to horizontal, said upper rim of said first slope being substantially longer than said upper rim of said second slope; said front wall tapering outwardly away from said rear wall so that when the like container is stacked on the container an access opening to the open top of each container is formed at the front thereof; at least one ledge formed in each of said side walls and extending into the material receiving portion; each of said ledges having an upper step and a lower step; a rib extending upwardly from each said lower step; and a socket formed in said bottom surface for each said rib; said sockets beign alignable with the ribs of the like container so that each said socket can engage each rib of the like container; the relative position of said sockets and said ribs being such that when the like container is stacked on the contaienr the front wall of the like container is above and adjacent to said front wall of the contaienr and the rear wall of the like container is above and adjacent to said front wall of the container and the rear wall of the like container is above and adjacent to said rear wall of the contaienr thereby aligning the access opening of the like container with said access opening of the container.

15. A container according to claim 14 wherein said side walls taper outwardly away from each other so that the open top is wider than said bottom surface.

16. A container according to claim 14 wherein said rear wall is higher than said front wall.

17. A container according to claim 14 wherein each said side wall includes two said ledges and said bottom surface includes four said sockets.

18. A container, capable of being nested within a like container, comprising a bottom surface; a front wall, rear wall and two side walls extending upwardly from said bottom surface to an upper rim which defines an open top, material receiving portion, of the container; said side walls tapering away from each other as they extend upwardly from said bottom surface to said upper rim; outer depressions in each said side wall forming inner projections in each said side wall; said outer depressions in each said side wall being spaced from each other to form inner depressions and outer projections in each said side wall; a ledge formed near the top of each said inner projection, each of said ledges having an upper step and a lower step; a rib extending upwardly from each said lower step; and a socket formed in said bottom surface for each rib; said sockets being alignable with the ribs of the like container so that each said socket can engage each rib of the like container; said upper rim having two slopes, a first slope extending from said front wall and along said side walls and a second slope extending from said rear wall along said side walls to said first slope; said second slope being generally horizontal and said first slope being at an angle to horizontal,said upper rim of said first slope being substantially longer than said upper rim of said second slope; the container being nestable within the like container by selectively positioning the container on said bottom surface or on said first slope of said upper rim and positioning the like container so that its outer projections in each side wall are received in said inner depressions of the container and so that the outer depressions in each side wall of the like container receive said inner projections in each said side wall; said container and the like container when nested and when positioned on said first slope having a constant outer lateral dimension.

19. A container according to claim 18 further comprising rib means extending from said upper rim downwardly a preselected distance along each said side wall, said rib means being adapted to engage the upper rim of the like container when the container is nested within the like container.

20. A container according to claim 18 wherein said rear wall is higher than said front wall.

21. A container according to claim 20 wherein said rear wall is generally perpendicular to said bottom surface but at an angle less than ninety degrees to said second slope of said upper rim.

22. A container according to claim 18 wherein said outer depressions and said inner projections in each said side wall are tapered having side edges which converge toward each other as said outer depressions and said inner projections extend upwardly in each said side wall from said bottom surface toward said upper rim.

23. A container according to claim 22 wherein said inner depressions and said outer projections in each said side wall are tapered having side edges which diverge from each other as said inner depressions and said outer projections extend upwardly in each said side wall from said bottom surface toward said upper rim.

* * * * *

UNITED STATES PATENT AND TRADEMARK OFFICE
CERTIFICATE OF CORRECTION

PATENT NO. : 5,071,008

DATED : Dec. 10, 1991

INVENTOR(S) : John L. Hradisky

It is certified that error appears in the above-identified patent and that said Letters Patent is hereby corrected as shown below:

Title page, item, [56], please add the following under U.S. Patent Documents and Other Publications:

| | | | |
|---|---|---|---|
| --2,994,457 | 8/1961 | Fornas | 220/97 |
| 3,113,680 | 12/1963 | Frater et al. | 211/126 |
| 3,170,594 | 2/1965 | Nascher | 220/97 |
| 3,252,614 | 5/1966 | Evans | 220/97 |
| 3,347,394 | 10/1967 | Gould | 211/126 |
| 4,000,817 | 1/1977 | Sanders et al. | 206/505 |
| 4,015,713 | 4/1977 | Clipson et al. | 206/509 |
| 4,015,886 | 4/1977 | Wickenberg | 312/107 |
| 4,194,626 | 3/1980 | Boller | 206/509 |
| 4,316,540 | 2/1982 | Lapham | 206/507 |
| 4,416,374 | 11/1983 | Smith et al. | 206/507 |
| 4,550,837 | 11/1985 | Simmons | 211/126 |
| 4,760,921 | 8/1988 | Licari | 206/504 |

OTHER PUBLICATIONS

Arrow Star Discount Incorporated, 674 William St., Lynbrook, NY 11563; catalog pp. 70-72, 75; date unknown.
Curver B.V., P.O. Box 6810, 4802 HV, Breda, Holland; catalog pp. 8 and 9; 1988.
Frem Corporation, 60 Webster Place, Worcester, MA 01603-0004; one advertising sheet; date unknown.
IPL Products, Ltd., 348 Park St., Suite 201, North Reading, Mass. 01864-2152; 2 advertising sheets; date unknown.
Lodal, Inc., P.O. Box 2315, Kingsford, Michigan 49801; one advertising sheet; date unknown.

UNITED STATES PATENT AND TRADEMARK OFFICE

CERTIFICATE OF CORRECTION

PATENT NO. : 5,071,008

DATED : Dec. 10, 1991

INVENTOR(S) : John L. Hradisky

It is certified that error appears in the above-identified patent and that said Letters Patent is hereby corrected as shown below:

Piper Casepro, 12001 Corporate Drive, Dallas, TX 75228; 2 advertising sheets; date unknown.
Rehrig Pacific Company, 4010 East 26th Street, Los Angeles, CA 90023; 5 advertising sheets; dates unknown.
Rubbermaid Incorporated, Wooster, Ohio 44691; 1 advertising sheet; 1988.
Tucker Housewares; 2 advertising sheets; date unknown.
Zarn, Inc., Box 1350, Reidsville, NC 27323; one advertising sheet; date unknown.--

Cover page, [57], Abstract, fourth line from bottom "depression (24,25)" should read --depressions (24,25)--.

Column 1, line 39, "cf" should read --of--.

Column 2, line 34 "cf" should read --of--.

Column 3, line 39, "1" should read --10--.

Column 7, line 13, claim 9, "expending" should read --extending--.

Column 8, line 4, claim 14, "beign" should read --being--.

Column 8, line 8, claim 14, "contaienr" should read --container--.

Column 8, line 10, claim 14, "contaienr" should read --container--.

UNITED STATES PATENT AND TRADEMARK OFFICE

CERTIFICATE OF CORRECTION

PATENT NO. : 5,071,008

DATED : Dec. 10, 1991

INVENTOR(S) : John L. Hradisky

It is certified that error appears in the above-identified patent and that said Letters Patent is hereby corrected as shown below:

Column 8, line 11, claim 14, "front" should read --rear--.

Column 8, lines 11-13, claim 14, following the word "container" delete the words "and the rear wall of the like container is above and adjacent to said rear wall of the contaienr".

Column 8, line 48, claim 14, "horizontal,said" should read --horizontal, said--.

Signed and Sealed this

Third Day of August, 1993

*Attest:*

Michael K. Kirk

MICHAEL K. KIRK

*Attesting Officer*

*Acting Commissioner of Patents and Trademarks*